US009187888B2

(12) United States Patent
Hennes et al.

(10) Patent No.: US 9,187,888 B2
(45) Date of Patent: Nov. 17, 2015

(54) DRAIN, IN PARTICULAR SHOWER DRAIN

(75) Inventors: Frank Hennes, Finnentrop (DE); Johannes Arndt, Attendorn (DE)

(73) Assignee: Viega GmbH & Co. KG, Attendorn (DE)

( * ) Notice: Subject to any disclaimer, the term of this patent is extended or adjusted under 35 U.S.C. 154(b) by 438 days.

(21) Appl. No.: 13/576,772

(22) PCT Filed: Apr. 11, 2011

(86) PCT No.: PCT/EP2011/055615

§ 371 (c)(1), (2), (4) Date: Oct. 11, 2012

(87) PCT Pub. No.: WO2011/131503

PCT Pub. Date: Oct. 27, 2011

(65) Prior Publication Data

US 2013/0025047 A1 Jan. 31, 2013

(30) Foreign Application Priority Data

Apr. 22, 2010 (DE) ..... 20 2010 006 024 U

(51) Int. Cl.

| | |
|---|---|
| ***E03C 1/12*** | (2006.01) |
| ***E03F 5/04*** | (2006.01) |
| ***F04D 13/04*** | (2006.01) |
| ***F04D 13/02*** | (2006.01) |
| ***E03C 1/122*** | (2006.01) |

(52) U.S. Cl.

CPC ... *E03F 5/04* (2013.01); *E03C 1/12* (2013.01); *E03C 1/1227* (2013.01); *F04D 13/024* (2013.01); *F04D 13/046* (2013.01)

(58) Field of Classification Search

CPC .... E03C 1/1227; F04D 13/024; F04D 13/046
USPC ..... 4/679, 688
See application file for complete search history.

(56) References Cited

U.S. PATENT DOCUMENTS

| | | | |
|---|---|---|---|
| 3,773,106 | A | 11/1973 | Levy |
| 8,006,325 | B2 | 8/2011 | Stimpson et al. |
| 8,286,279 | B2 | 10/2012 | Stimpson |
| 2007/0277306 | A1 | 12/2007 | Grooms et al. |

FOREIGN PATENT DOCUMENTS

| | | | |
|---|---|---|---|
| CN | 1074979 | A | 8/1993 |
| CN | 2418277 | Y | 2/2001 |
| CN | 2793384 | Y | 7/2006 |
| CN | 2869152 | Y | 2/2007 |
| CN | 101605943 | A | 12/2009 |
| DE | 202008011354 | U1 | 3/2010 |
| EP | 1243709 | B1 | 3/2009 |
| EP | 1819885 | B1 | 8/2010 |
| FR | 2923501 | A1 | 5/2009 |
| NL | 7212477 | | 3/1973 |
| WO | 2005059259 | A1 | 6/2005 |

*Primary Examiner* — Tuan N Nguyen

(74) *Attorney, Agent, or Firm* — The Webb Law Firm

(57) ABSTRACT

A drain for a wet room, in particular for a shower, includes a drain housing at which an outlet for connecting a drain pipe. In order for a drain of this type to offer a higher drainage capacity in the case of a given drain pipe of standard diameter, the drain housing has a pump for conveying water towards the outlet. The pump is provided with a hydraulic drive. The wet room, in particular a shower, includes a water supply line and a drain of the above-mentioned type.

13 Claims, 3 Drawing Sheets

DRAIN, IN PARTICULAR SHOWER DRAIN

BACKGROUND OF THE INVENTION

1. Field of the Invention

The invention relates to a drain for a wet room, preferably for a shower, comprising a drain housing at which an outlet for connecting a drain pipe is provided. In particular, the invention relates to a shower or wet room comprising a drain of this type.

2. Description of the Related Art

Drains for shower tubs or shower trays and floor drains for barrier free showers are known in a variety of configurations. These drains must have a relatively high drainage capacity. A high drainage capacity is required in particular for showers equipped with rain shower heads. Rain showers of this type are popular with many people and are in increasing demand. However, the drainage capacity of conventional shower drains is generally limited owing to various constraints.

SUMMARY OF THE INVENTION

The object of the present invention is to provide a drain of the type mentioned at the outset which offers a higher drainage capacity in the case of a given drain pipe of standard diameter.

The drain according to the invention is characterised in that the drain housing thereof is provided with a pump for conveying water towards the outlet.

The pump makes it possible, in the case of a given drain pipe inner diameter of, for example, 34 mm or 44 mm, to increase the drainage capacity significantly compared to that of a conventional drain which functions exclusively according to the principle of gravitational drainage.

In an advantageous configuration of the drain according to the invention, the pump is provided with a hydraulic drive. This configuration makes it possible to use the energy of the water flowing into the shower or the wet room to accelerate the draining water. No additional control elements are required for this purpose. A synergy effect is thus produced which uses the energy of inflowing water to increase the drainage capacity. This effect can be used in showers in particular. The higher the volume flow rate of the inflowing water, the greater the capacity of the pump and the higher the drainage capacity of the drain according to the invention.

Another advantageous configuration of the drain according to the invention consists in the pump being formed from a pump impeller mounted in the drain housing, the hydraulic drive comprising a drive wheel (paddle wheel) which can be loaded with water and is coupled to the pump impeller via a magnetic coupling. This configuration offers advantages regarding the assembly of the pump and regarding the tightness of the drain housing, for in this configuration a drive shaft, which would optionally extend into the drain housing from outside and require shaft seals, is not required for driving the pump impeller. Seals of this type are relatively complex. In this preferred configuration, the drain according to the invention operates without a drive shaft penetrating the drain housing. The rotation of the drive wheel is transmitted to the pump impeller in a contact-free manner by the magnetic coupling. The reliable tightness of the drain housing is therefore not impaired. The magnetic coupling also offers the advantage that the pump impeller can easily be removed from the drain housing for cleaning purposes. In this configuration it is not necessary to release a mechanical shaft connection.

The magnetic coupling between pump impeller and drive wheel can be implemented by providing the drive wheel and the pump impeller with embedded magnets. Alternatively, and in a particularly preferred manner, the drive wheel and the pump impeller can also be made of magnetised plastics material.

The pump impeller is preferably formed in the manner of the impeller of a centrifugal pump, particularly preferably as a radial wheel or semi-axial wheel of a centrifugal pump.

BRIEF DESCRIPTION OF THE DRAWINGS

Further preferred and advantageous configurations of the drain according to the invention are given in the dependent claims. The invention is described in further detail below with reference to drawings showing an embodiment. In the drawings:

DETAILED DESCRIPTION OF THE INVENTION

Figure 1:
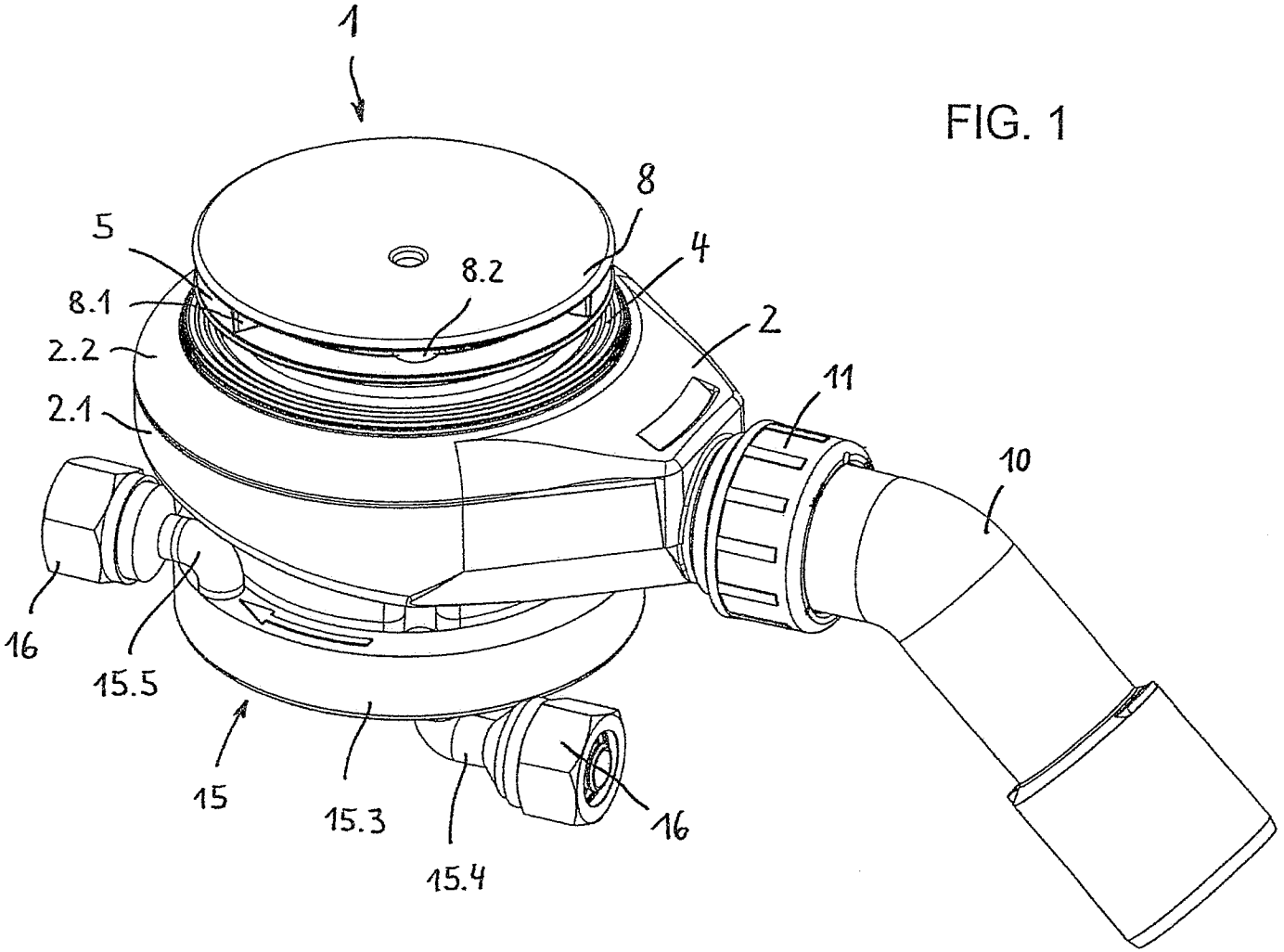
FIG. 1 is a perspective view of a drain according to the invention for shower tubs, with an attached drain pipe bend.
Figure 2:
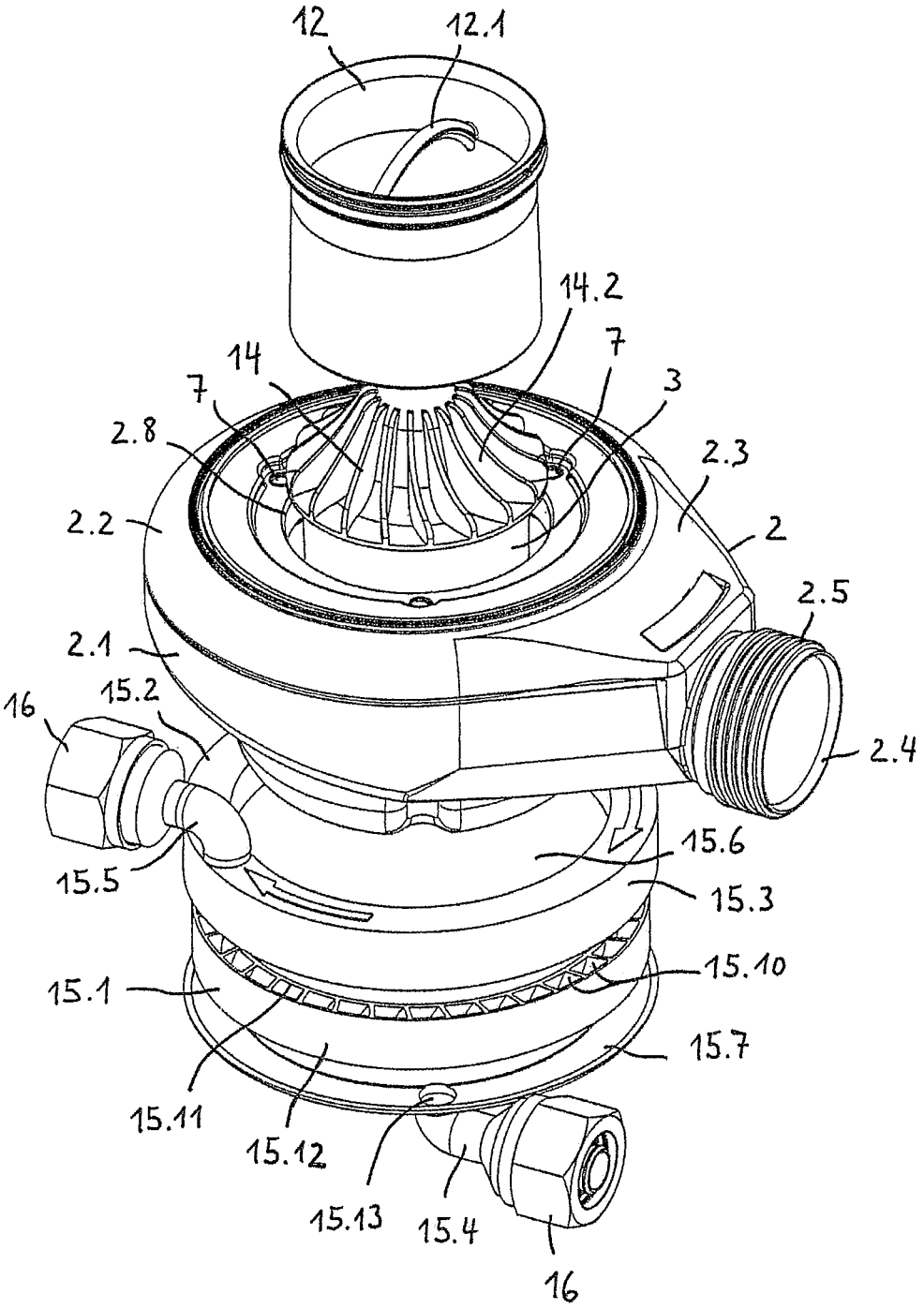
FIG. 2 is a perspective exploded view of parts of the shower drain of FIG. 1.

The drain 1 shown in the drawings is a shower drain which is mounted at the drain opening of a shower tub or shower tray (not shown).

The drain 1 comprises a drain housing 2 which is produced from plastics material and made up of a cup-like housing part 2.1 and a housing cover 2.2. The housing cover 2.2 is connected to the cup-like housing part 2.1 in a liquid-tight manner and comprises an inlet opening 3 which is surrounded by a rubber-resilient sealing ring 4. The upper side of the sealing ring 4 has a peripheral rib profile. The drain housing 2 is fixed at the drain opening of the tub or shower tray by means of a fastening flange 5. For this purpose, the fastening flange 5 comprises three bored holes, distributed uniformly over the periphery thereof, into which fastening screws (not shown) are inserted. Threaded sleeves 7 which are cast in the housing cover 2.2 are assigned to the fastening holes. A covering cap 8 which covers the inlet opening 3 of the drain housing 2 is releasably mounted on the fastening flange 5. Web-shaped spacers 8.1 which limit the inlet slits, and sleeve-shaped insertion elements 8.2 which receive the cylindrical heads of the fastening screws, are formed on the lower side of the covering cap 8. The heads of the fastening screws (not shown) are each provided with an annular groove and a rubber ring (not shown) inserted therein. This results in a frictionally engaged connection between the screw heads and the sleeve-shaped insertion elements 8.2 of the covering cap 8.

The drain housing 2 has a lateral extension 2.3 which opens into a connecting piece 2.4 as an outlet. A curved drain pipe (outlet bend) 10 is inserted into the connecting piece 2.4. The drain pipe 10 carries, at its insertion end, a conical sealing ring (not shown) and is connected in a liquid-tight manner to the outlet of the drain housing 2 by means of a union nut 11 which is screwed to the external thread 2.5 of the connecting piece 2.4.

The drain housing 2 forms an odour trap. For this purpose, the drain housing has an immersion pipe 12 inserted therein and a partition wall 2.6 which is arranged between the inlet opening 3 and the outlet 2.4, extends upwards from the base of the cup-shaped housing part 2.1 and defines an overflow edge 2.7. The immersion pipe 12 is substantially cylindrical and is held at an annular shoulder face or conical face 2.8 of the housing cover 2.2. For removal thereof, the immersion pipe 12 has a handle 12.1 extending transverse to the centre axis.

An opening 2.9 which is sealed by a removable plug 13 is formed in the partition wall 2.6, through which opening a cleaning spiral can, when necessary, be introduced into the drain pipe 10 connected to the connecting piece (outlet) 2.4 after removal of the immersion pipe 12 and the plug 13. The cleaning opening 2.9 is flush with the outlet or connecting piece 2.4. The plug 13 is provided with a handle element 13.1 which projects into the cup-like housing part 2.1 and towards the immersion pipe 12, the immersion pipe 12 simultaneously serving as a stop for the handle element 13.1. The handle element 13.1 is preferably web-shaped or rib-shaped, projects radially with respect to the cylindrical plug 13 and is orientated substantially vertically, in order not to significantly hinder water from draining away towards the outlet 2.4. The plug 13 is thus prevented by its projecting handle element 13.1 and the immersion pipe 12 contacting it from moving out of the cleaning opening 2.9 of the partition wall 2.6.

To increase the drainage capacity, the shower drain 1 is provided with a pump. The pump consists of a pump impeller (paddle wheel) 14 mounted in the drain housing 2 and is driven by a hydraulic drive 15. The hydraulic drive 15 consists of a drive wheel (outer paddle wheel) 15.1 which is arranged in a housing 15.3 comprising an annular duct 15.2. The housing 15.3 comprises an inlet port 15.4 and an outlet port 15.5. The ports 15.4, 15.5 are provided with union nuts 16 for the liquid-tight connection of a water supply line (not shown) and a water supply line (not shown) leading to the shower head, respectively. The ports 15.4, 15.5 are integrally formed on the housing 15.3 in such a way that the drive wheel 15.1 is loaded substantially axially by water supplied via the port 15.4. The inlet opening, assigned to the port 15.4, and the outlet opening, assigned to the port 15.5, of the housing 15.3 are offset from one another and arranged at opposite sides of the housing. In the embodiment shown, the inlet opening 15.13 is located in the lower side of the housing 15.3, while the outlet opening is formed in the upper side of the housing 15.3. The upper side of the drive housing 15.3 comprises a recess 15.6 which is defined by the annular duct 15.2 and into which the base portion of the cup-like housing part 2.1 of the drain housing 2 is inserted. The lower side of the drive housing 15.3 is sealed in a liquid-tight manner by a plate-shaped base 15.7 after insertion of the drive wheel 15.1. The inner face of the base 15.7 comprises an annular elevation 15.8 which serves as a slide face for the drive wheel 15.1. In addition, the upper part of the housing 15.3 comprises, at the lower side of the recess 15.6, a downwardly projecting, annular or disc-shaped projection 15.9 which serves as a shaft for the hub of the drive wheel 15.1. The paddles 15.10 of the drive wheel 15.1 are connected to an inner cylindrical wheel portion 15.11 and an outer cylindrical wheel portion 15.12 of the drive wheel. They are orientated so as to be oblique or inclined relative to the main flow axis of the water flowing in via the port 15.4. In the embodiment shown, the paddles 15.10, viewed in the direction of rotation of the drive wheel 15.1, are inclined from the upper side towards the lower side of the drive wheel 15.1 and housing 15.3.

Figure 3:
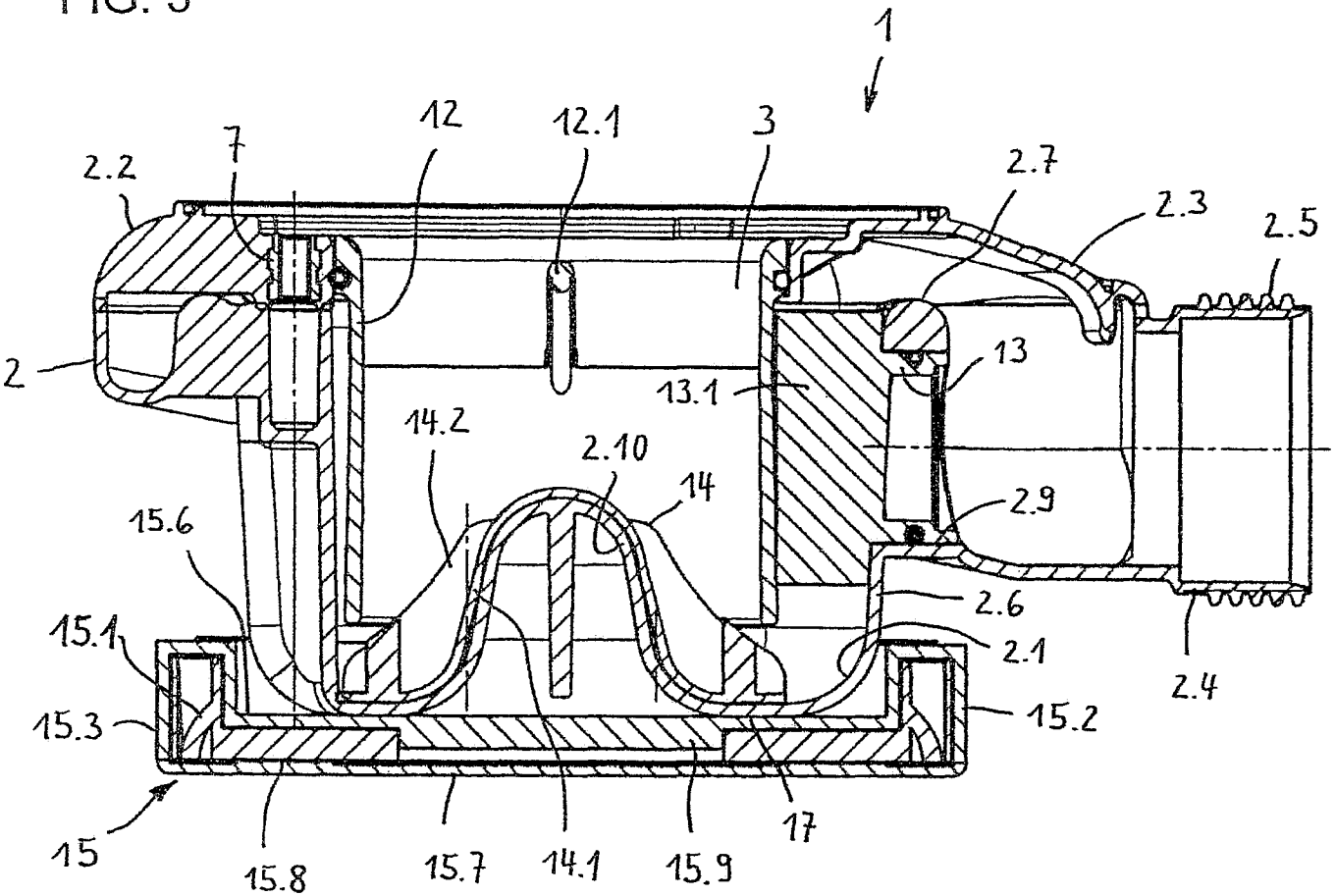
FIG. 3 is a vertical sectional view of the shower drain of FIG. 1 (without drain pipe bend and without sealing ring, fastening flange and covering cap).

The pump impeller 14 arranged inside the drain housing 2 is formed in the manner of the impeller of a centrifugal pump. Said impeller is constructed as a radial wheel or semi-axial wheel and comprises a bell-shaped wheel hub 14.1 by means of which it is rotatably mounted on a bell-shaped elevation 2.10 of the drain housing base (cf. FIG. 3). The bell-shaped elevation 2.10 of the drain housing base and the pump impeller 14 mounted thereon project into the immersion pipe 12. The paddles 14.2 of the pump impeller are curved. Each paddle 14.2 of the pump impeller is curved from the hub 14.1 towards the outer periphery, counter to the direction of rotation of the pump impeller 14. Viewed as a whole, the pump impeller 14 is substantially conical.

The pump impeller (inner paddle wheel) 14, which is separated from the drive wheel 15.1 in a liquid-tight manner by the wall of the drain housing 2 and the wall of the drive housing 15.3, is coupled to the drive wheel 15.1 by a magnetic coupling 17. For this purpose, the two paddle wheels 14, 15.1 are provided with embedded magnets or made of magnetised material, preferably magnetised plastics material.

The drain 1 shown thus makes it possible to implement a shower or a wet room in which the energy of the inflowing water is used to accelerate the draining water. The inflowing water is carried via the drive wheel 15.1 constructed as a paddle wheel and sets it in rotational movement. This movement is transmitted in a contactless manner via the magnetic coupling 17 to the inner paddle wheel (pump impeller) 14, which thereby accelerates the draining water and thus increases the drainage capacity. The inner paddle wheel 14 is freely accessible for cleaning purposes after removal of the immersion pipe 12. A constructional unit made up of the immersion pipe 12 and inner paddle wheel 14 is also conceivable.

The implementation of the invention is not limited to the above-described embodiment. Rather, numerous variants are possible which make use of the inventive idea given in the appended claims even in the case of basically different styling. Thus, the drain according to the invention may, for example, also be constructed as a floor drain for barrier-free showers (so-called walk-in showers). In particular, the shape of the paddles 14.2 and/or 15.10 can be varied. It is also within the scope of the invention to provide in the drive housing 15.3 a pivot pin bearing for the drive wheel 15.1, instead of a slide ring 15.8.

The application of the invention is not limited to showers. In principle, it can be used advantageously in any wet rooms where water supplied via a water supply fitting is also carried away simultaneously.

The invention claimed is:

1. A drain for a wet room, the drain comprising a drain housing at which an outlet for connecting a drain pipe is provided, wherein the drain housing is provided with a pump for conveying water towards the outlet, wherein the pump is provided with a hydraulic drive, wherein the pump is formed from a pump impeller mounted in the drain housing, and wherein the hydraulic drive comprises a drive wheel which can be loaded with water and is coupled to the pump impeller via a magnetic coupling.

2. The drain according to claim 1, wherein the pump impeller is formed in the manner of the impeller of a centrifugal pump.

3. The drain according to claim 1, wherein the drive wheel or the pump impeller is provided with embedded magnets.

4. The drain according to claim 1, wherein the drive wheel or the pump impeller is made of magnetised plastics material.

5. The drain according to claim 1, wherein the pump impeller comprises a bell-shaped wheel hub.

6. The drain according to claim 5, wherein the drain housing base comprises a bell-shaped elevation on which the wheel hub is rotatably mounted.

7. The drain according to claim 1, wherein the drain housing comprises a cup-like housing part into which an immersion pipe is inserted to form an odor trap.

8. The drain according to claim 1, wherein the pump impeller is conical.

9. The drain according to claim 7, wherein the pump impeller and the immersion pipe are formed as a single-piece constructional unit.

10. The drain according to claim 1, wherein the drain housing comprises, between an inlet opening and the outlet, a partition wall defining an overflow edge, an opening which is flush with the outlet and sealed by a removable plug being formed in the partition wall.

11. The drain according to claim 10, wherein the plug is provided with a handle element which projects into the cup-like housing part, the immersion pipe simultaneously functioning as a stop for the handle element.

12. A wet room, comprising a water supply line and a drain, wherein the drain includes a drain according to claim 1, the pump being integrated in the water supply line.

13. The drain according to claim 2, wherein the pump impeller is a radial wheel or a semi-axial wheel, preferably as a radial wheel or semi-axial wheel of a centrifugal pump.

* * * * *